US006196323B1

(12) United States Patent
Møksvold

(10) Patent No.: US 6,196,323 B1
(45) Date of Patent: Mar. 6, 2001

(54) WELL HEAD SYSTEM

(75) Inventor: Harald Møksvold, Maura (NO)

(73) Assignee: Mercur Slimhole Drilling and Intervention AS, Sandes (NO)

( * ) Notice: Subject to any disclaimer, the term of this patent is extended or adjusted under 35 U.S.C. 154(b) by 0 days.

(21) Appl. No.: 09/194,314

(22) PCT Filed: May 26, 1997

(86) PCT No.: PCT/NO97/00132

§ 371 Date: Mar. 29, 1999

§ 102(e) Date: Mar. 29, 1999

(87) PCT Pub. No.: WO97/45624

PCT Pub. Date: Dec. 4, 1997

(30) Foreign Application Priority Data

May 24, 1996 (NO) ..... 962121

(51) Int. Cl.[7] ..... E21B 33/00

(52) U.S. Cl. ..... 166/368; 166/382; 166/208; 166/380

(58) Field of Search ..... 166/97.5, 206, 166/208, 368, 380–382, 387

(56) References Cited

U.S. PATENT DOCUMENTS

| | | | |
|---|---|---|---|
| 3,720,261 | * | 3/1973 | Heilhecker et al. . |
| 4,646,842 | | 3/1987 | Arnold et al. . |
| 4,960,174 | | 10/1990 | Rodrigues et al. . |
| 4,969,517 | * | 11/1990 | Valka et al. . |
| 5,184,686 | | 2/1993 | Gonzalez . |
| 5,273,117 | | 12/1993 | Reimert . |
| 5,299,643 | | 4/1994 | Vetter et al. . |
| 5,620,052 | * | 4/1997 | Turner . |
| 5,857,524 | * | 1/1999 | Harris et al. . |

FOREIGN PATENT DOCUMENTS

| | | |
|---|---|---|
| 0422705 | 4/1991 | (EP) . |
| 2193520 | 2/1988 | (GB) . |
| 2245624 | 1/1992 | (GB) . |
| 2310679 | 9/1997 | (GB) . |

* cited by examiner

*Primary Examiner*—Roger Schoeppel
(74) *Attorney, Agent, or Firm*—Hedman & Costigan, PC

(57) ABSTRACT

The present invention relates to a well head system, especially in connection with high pressure wells, and in order to reduce the weight of steel involved, as well as avoiding unnecessary equipement in the well head, it is according to the present invention suggested a casing programme based on liners, having the same pressure integrity as the casing on which the well head is mounted.

8 Claims, 2 Drawing Sheets

WELL HEAD SYSTEM

FIELD OF THE INVENTION

The present invention relates to a well head system, especially in connection with high pressure wells.

BACKGROUND OF THE INVENTION

As shown in FIG. 1, a conventional 18¾" well head (2) will usually be mounted on a casing (4) having the dimension of 18⅝" or 20". Such a casing will not have a pressure integrity equal to that of the well head, and it is therefore necessary to use new casings (6) having higher pressure integrity later in the well, which must be tied back to the high pressure well head in order for the well to have the same pressure integrity as said well head. According to conventional technique this will be provided by using so-called casing hangers (8) with associated gaskets between casing hangers and said well head. Normally there will be space for three casing hangers in a well head with associated gaskets and equipment therefor.

In order for such a conventional well head to be operable a lot of extra equipment is required. Such equipment will involve:

casing hangers, pack of assemblies, seal assemblies, wear bushings, one for each casing hanger, normally three pieces, running tool for casing hangers, universal tool and full bore casing hanger running tools, running tool for pack-off assembly/seal assembly, running tool for wear bushings, milling and flushing tools for seal assembly/pack-off assembly.

OBJECTS OF THE INVENTION

One object of the present invention is to provide a well head system which to a substantial degree will reduce the equipment involved therein.

Another object of the present invention is to drastically reduce the weight of steel involved during drilling in such a well head system.

A further object of the present invention is to provide a well head system which can specifically be used for testing a blow out preventer in a more rational and less costly manner.

SUMMARY OF THE INVENTION

These objects are achieved in a well head system of the type as stated in the preamble, which according to the present invention is characterized in that said well head system comprises a casing programme based on liners.

This will drastically reduce the weight of steel involved during drilling operation.

Also, by using such a well head system all the previously listed equipment and tools will become unnecessary, because the present well head to be used will not have facilities for using casing hangers, but take the advantage of using liners instead.

The present well head system with its well head is particularly adaptable for a drilling within a dimensional range which can be used for testing a blow out preventer, but it is not necessary with profiles in order to encounter casing hangers and associated pack-off/seal assemblies.

Neither is there in the present well head system a requirement for including wear bushings, since it will not occur any reduction in the drilling of the well head, as this is represented by a casing hanger. Further, it is not necessary to include wear bushings because it is not the sealing area in the well head which has to be protected, as the case is in connection with standard well heads.

Another advantage with the present well head system including a casing programme based on liners, is a reduced weight of steel, which in a normal North Sea well can be approximately 150 tons of steel.

The present well head system is especially adapted for slim hole drilling including a well head of reduced diameter, which means less pipe dimensions during drilling operation with less clearance between casings and drill head.

Further features and advantages of the present well head system will appear from the following description taken in connection with the appended drawings, as well as from the enclosed patent claims.

BRIEF DISCLOSURE OF THE DRAWINGS

WELL HEAD SYSTEM WITH CASINGS

General

Figure 1:
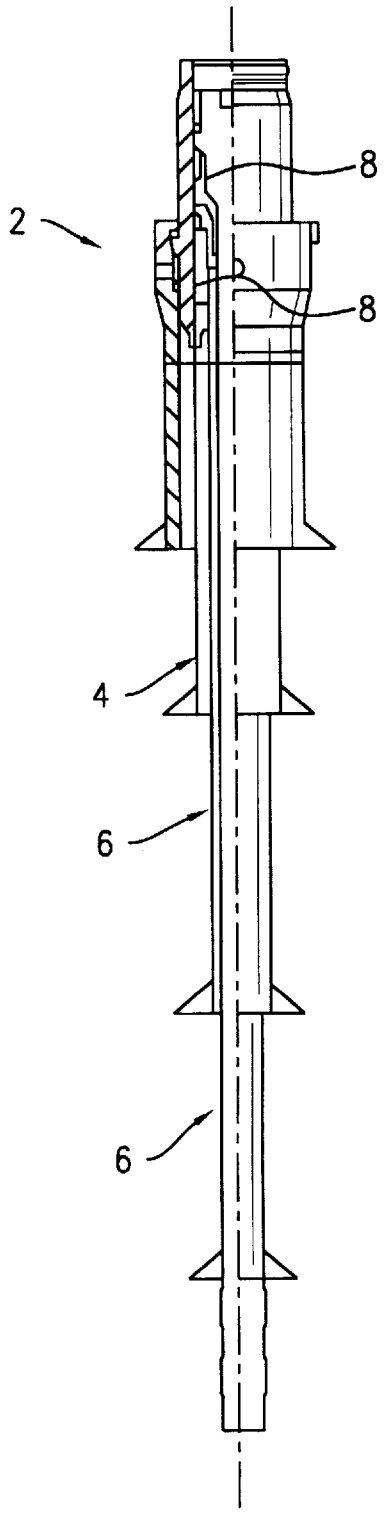
FIG. 1 (PRIOR ART)
FIG. 1 is a side view, partly in section, illustrating a conventional well design.
Figure 2:
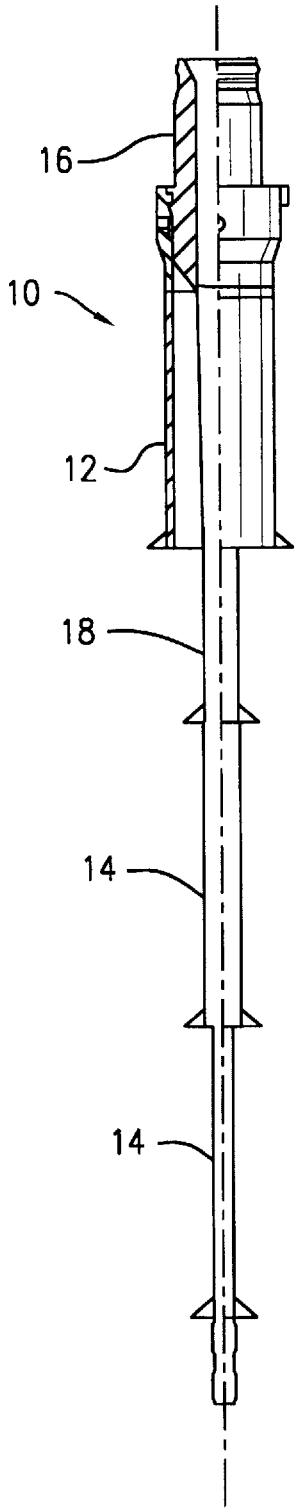
FIG. 2 is a side view, partly in section, illustrating a well head system including a well design according to the present invention.
Figure 3:
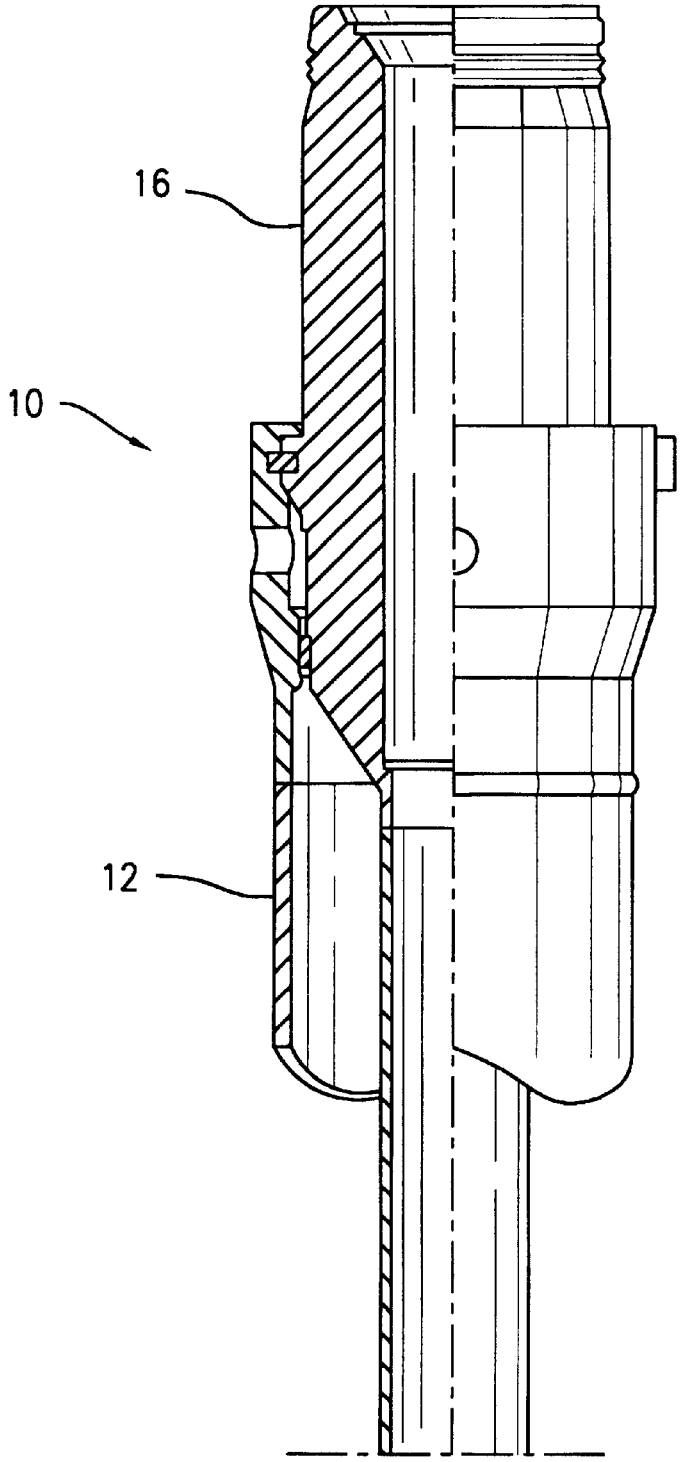
FIG. 3 is on a larger scale a side view, partly in section, of a high pressure well head to be used according to the present invention.

The well head of the present invention, shown in FIGS. 2 and 3, shall be of subsea type with reentry connector profile and guide bases as required. The well head system (10) shall be strong enough to cater for the environmental conditions applying with the BOP and riser system installed tied back to the surface vessel.

The system shall be pressure rated to 690 bar. The bore of the high pressure well head housing shall be ø235 mm (9¼") and shall as basis carry an 11" ABB Vetco Gray H4 mandrel connector profile with both VX and VT sealing area. However, other well head connector profiles may be used.

The well head system (10) shall carry a guideline-less reentry structure base. The guide base shall be subjected to change-out also after installation on the sea bed.

All necessary running tools and test tools shall be available for the well head and external structures. Below is a list of the most required tools.

The first casing or conductor (12) shall form the foundation of the well head and be designed such that it can carry all external loads from the BOP system and riser (transferred through the high pressure well head.

The upper termination point for the conductor (12) shall form a well head to accept and lock the high pressure housing (16) to same. Alternatively, the high pressure housing and conductor housing can be made in on piece.

The next following casing (18) shall carry the high pressure well head. The casing shall have pressure integrity to allow the maximum expected pressure that is expected in the well, limited to the maximum working pressure for the well head, 690 bar.

The design shall be based upon use of liners (14) including liner hang-off and sealing assemblies to be set in previous run casing or liner. This is feasible because the casing carrying the high pressure well head shall have pressure integrity to allow for the maximum expected pressure in the well or max 690 bar. Further, the design of the well head shall not allow transfer of any loads to the surface carrying the high pressure well head.

Well Head Design Philosophy

The philosophy behind this well head system is to simplify the well head and save costs.

By introducing a minimum of sealing areas and critical dimensions in the conductor housing and high pressure well head, the system is well suited for reuse several times. In combination of not using any casing hangers (8), the casing (6) from the previous set casing shoe and up to the well head is eliminated, at least for minimum of two casings including casing hangers (8) and seal assemblies per well.

Further, the use of smaller casings and liners reduces the mud volume during drilling and cement volume during cementing operations.

The total cost savings have not yet been verified, but are expected to be significant, probably 40–50% savings, related to the total well cost.

Components For the Well Head System

Conductor Housing with Interface to High Pressure Well Head Housing

The conductor housing (16) forms the top termination point of the conductor string. This string shall form the foundation for the well head and be designed to handle all loads affected by external loads. The housing shall accommodate the high pressure well head such that all external loads affected to the high pressure well head will be transferred to the conductor housing.

The conductor shall have a pressure integrity to allow for cementing during installation. The maximum pressure is estimated to 100 bar.

A running tool for the conductor housing with conductor string will be available.

High Pressure Well Head

The high pressure well head shall carry the surface casing (18). The casing shall have pressure integrity to cater for the maximum expected well bore pressure limited to 690 bar. The well head bore shall be ø235 mm (9¼") and contain profile for the running tool.

The connector profile shall be 11" ABB Vetco Gray H4 profile as basis, with both VX and VT sealing profile. The sealing areas shall have weld overlay with ANSI 316 as a minimum, UNS N 06625 will be preferred.

The housing (16) shall terminate downwards to a weld preparation in compliance with the surface casing.

Alternatively, the conductor housing and high pressure well head can be made in one piece. This will of course reduce the cost, but requires a special running and installation procedure. The rig itself shall be able to cater for the running procedure, but the operator will need to approve the installation method and procedure.

A running tool for the high pressure well head with surface casing shall be available together with a BOP test tool. For certain situations a debris cap or corrosion cap for the well head will be made available including an overtrawlable structure.

No wear bushings or seal protectors, casing hangers with seal assembly and running tools for same will be required.

Casing Programme

The casing programme for this well head design is as follows:

24" conductor.

10¾" or 9⅝" surface casing.

7" or 7⅝" liner.

5" liner.

leaving a 4⅛" hole, or 4¾" hole using a Bicentrical bit.

As contingency a 13⅜" casing or liner may be used before setting the surface casing. After having set the surface casing a different casing programme than listed may be used to avoid smaller hole size than 4⅛" at the bottom. At present we are working with this configuration.

The system shall allow for a drill stem test by installing a subsea test tree in the subsea BOP stack and well head to allow for a conventional set up for such a test.

If the well is to be a producer, a subsea production tree with flowline will be required. For such an installation a type of horizontal tree will be preferred, where the tubing hanger will be landed. Accordingly, no profile in the well head is required.

Guide Bases

The system shall cater for two guide bases, a temporary guide base and permanent guide base.

Temporary Guide Base

The system shall include a temporary guide base which will be used if required. A running tool will be available for this. The guide base shall have sonar reflectors and carry baskets for acoustic beacons to detect the guide base for reentry.

As an alternative to the temporary guide base a mud mat carried by the permanent guide base and the conductor shall be made available. The mud mat will not require any running tools.

Permanent Guide Base

The permanent guide base shall form a reentry structure for guideline less system.

It shall be carried by the conductor housing and be retrievable and re-runable also after installation at the sea bed. Running and retrieving tools shall be made available.

Running and Testing Tools

To ensure a safe and easy installation of the well head system a number of running and testing tools shall be made available. The tools shall be designed for easy handling with interface in compliance with the drill string and components for handling same to the case installation and handling.

Running Tool for Conductor with Conductor Housing

To enable installation and handling of the conductor with conductor housing, a running tool shall be forwarded. The running tool shall be cam actuated and locked to the conductor housing by left hand rotation of running string, and right hand rotation for release. The tool shall not be rotated through this operation, only the stem or string. Further, a stop profile shall be made in order to stop tool from rotation in this process.

The interface upwards to the installation string shall be 4½" IF box. The downward interface to a cement stringer shall be 4½" IF pin.

The tool shall have plugged through bores with minimum of 1 valve to enable fill-up of the conductor during running through the splash zone. After being completely submerged in the sea and conductor completely filled with sea water, the valve shall be closed by pulling a rope connected to the valve. The rope will then be cut and retrieved with the installation string.

The running tool shall be able to carry the total weight of the conductor string and have pressure integrity in compliance with the conductor housing.

Running Tool for High Pressure Housing with Surface Casing

The design of this tool shall be based upon the running tool for the conductor housing. It shall be cam actuated and operated the same way, left hand rotation to lock and right hand rotation to unlock. No through bores in the tool shall apply.

The upward interface with installation string shall be 4½" IF box connection, and 4½" IF pin down. The stem shall have a through bore in compliance with tools for the cement operation and displacement operation during installation of the surface casing.

The tool shall be able to handle the weight of a full surface casing string and the pressure conducted by the cement operation.

BOP Test Tool

In order to conduct a full BOP stack test after installation a BOP test tool shall apply. The test tool shall be able to receive maximum pressure from above, and seal against the well head inside wall. The forces created by the pressure can be hung off in a BOP ram. The tool shall be designed for easy installation and retrieval.

Running Tool for Temporary Guide Base

To install and retrieve the temporary guide base, a running tool shall apply. The design shall reflect easy installation and disconnect at the sea bed. The capacity shall comply with the weight of the guide base with weight materials installed.

Running Tool for Permanent Guide Base

Normally the guide structure shall be installed onto the conductor housing prior to running of conductor and follow same during installation. Normally the structure will remain onto the conductor until the conductor is pulled for plug and abandoned. In such cases no running tool will be required. However, a running and retrieving tool shall be made available to enable a change out of the structure after installation at the sea bed.

The tool shall be designed for easy connection and disconnection to the guide base. To comply for tool control, ROV shall be used primarily. Hydraulic operations controlled form surface shall be avoided.

It is to be understood that the present invention devises a very simple subsea well head system, i.e. in combination with a well design based on a well head having the same pressure integrity as the casing on which the well head is mounted and the use of subsequent liners instead of casing which must be tied back to said well head due to pressure integrity. Further, it is to be understood that the term liner is used for casing which has been hung off at bottom level in previously set casing.

What is claimed is:

1. A well head system comprising a well head housing, a surface casing and one or more successive liners for thereby obtaining full pressure integrity without the need for a casing string.

2. The system of claim 1 wherein the well head housing has a bore of about 9–9¼".

3. The system of claim 2 wherein said high pressure well head is adapted for use in a drilling operation which can be used for testing a blow-out preventer.

4. The system of claim 3 wherein said successive liners do not include a hole size of less than 4⅛" at the bottom.

5. The system of claim 2 wherein said successive liners do not include a hole size of less than 4⅛" at the bottom.

6. The system of claim 1 wherein said high pressure well head is adapted for use in a drilling operation which can be used for testing a blow-out preventer.

7. The system of claim 6 wherein said successive liners do not include a hole size of less than 4⅛" at the bottom.

8. The system of claim 1 wherein said successive liners do not include a hole size of less than 4⅛" at the bottom.

* * * * *